United States Patent [19]

Redekop et al.

[11] Patent Number: 4,941,521

[45] Date of Patent: Jul. 17, 1990

[54] FINGER JOINTING GREEN LUMBER

[75] Inventors: Alfred W. J. Redekop, Langley; Derek Barnes, Vancouver, both of Canada

[73] Assignee: MacMillan Bloedel Limited, Vancouver, Canada

[21] Appl. No.: 416,634

[22] Filed: Oct. 3, 1989

[51] Int. Cl.[5] ..... B27F 1/00

[52] U.S. Cl. ..... 144/347; 144/2 R; 144/3 R; 144/91; 144/348; 156/322

[58] Field of Search ..... 144/2 R, 3 R, 90 R, 144/90 A, 91, 347, 348, 352; 156/300, 301, 304.2, 304.6, 322, 535

[56] References Cited

U.S. PATENT DOCUMENTS

| | | | |
|---|---|---|---|
| 3,927,705 | 12/1975 | Cromeens et al. | 144/3 R |
| 4,095,634 | 6/1978 | Berglund et al. | 144/3 R |

FOREIGN PATENT DOCUMENTS

| | | |
|---|---|---|
| 648428 | 9/1962 | Canada . |
| 662340 | 4/1963 | Canada . |
| 661101 | 7/1963 | Canada . |
| 726489 | 1/1966 | Canada . |
| 776350 | 1/1968 | Canada . |
| 785057 | 5/1968 | Canada . |
| 807625 | 3/1969 | Canada . |
| 809364 | 3/1969 | Canada . |
| 952772 | 8/1974 | Canada . |
| 991973 | 6/1976 | Canada . |
| 997661 | 9/1976 | Canada . |
| 1059409 | 7/1979 | Canada . |

*Primary Examiner*—W. Donald Bray

[57] ABSTRACT

Finger jointed lumber is produced from discrete green lumber pieces each formed with a first set of fingers on one end and a second set of fingers at the other end. The first set of fingers is dried by rapidly applying heat substantially solely through the first set of fingers in a first drying station. The second set of fingers is then rapidly dried in a second drying station. A thermo-setting adhesive is applied to the second set of fingers of each lumber piece while still hot and the second set of fingers on one piece and the first fingers on an adjacent lumber piece are mated and crowded together to form a joint. The adhesive is significantly cured by residual heat in the mating ends before significant moisture migrates back to the fingers from the bodies of the mating lumber pieces and interferes with the curing of the adhesive.

34 Claims, 4 Drawing Sheets

FINGER JOINTING GREEN LUMBER

Field of the Invention

The present invention relates to More particularly the present invention relates to finger jointing green lumber by drying fingers at first one end and then at the other end of each lumber piece, applying adhesive to fingers at one of the ends and securing the ends of consecutive pieces together by curing the adhesive using energy applied in drying the fingers before significant migration of moisture back into the fingers can significantly interfere with bonding of the fingers by the adhesive.

Background of the Invention

Finger jointing of dry lumber pieces is very well known and is practiced commercially in many different mills. Generally the method includes the steps of first drying the lumber pieces to a low moisture content, forming fingers at opposite ends of each lumber piece, applying adhesive to the fingers and then crowding the fingers together to join adjacent pieces and set the adhesive sometimes by the addition of heat to the mating fingers.

Various techniques for cutting the required fingers and applying adhesive to the fingers are well known. See for example Canadian patent 785,057 issued May 4, 1968 to Gates or 809,364 issued March 1, 1969 to Marian or 1,059,409 issued July 31, 1979 to Cook et al.

It is also known to use a heated die to compress and reform fingers at the end of lumber pieces and then apply an adhesive to the reformed fingers and secure together adjacent wood pieces by setting the thermosetting adhesive using residual heat from the reforming step as described in Canadian patent 776,350 issued Jan. 23, 1968 to Strickler.

The basic concept of storing heat in wood or the like and using the stored heat to set a thermosetting adhesive has been known for many years and is described for example in Canadian patents 662,340 issued Apr. 30, 1963 to Madsen; 648,428 issued Sept. 11, 1962 to McKeen et al or 807,625 issued Mar. 4, 1969 to Crofton.

Finger jointing of green lumber has also been suggested. Canadian patent 952,772 issued Aug. 13, 1974 teaches pre-treating wood with a particular chemical (an ethylene oxide adduct of a compound containing multi-active hydrogen functionality) to facilitate the formation of an adhesive joint. Canadian patent 991,973 issued June 29, 1976 to Makatsuka describes a concept of finger jointing green lumber by using a very particular type of adhesive namely a poly-isocyanate adhesive that presumably is not significantly affected by moisture.

Canadian patent 997,661 issued Sept. 28, 1976 to Chow also relates to finger jointing of green lumber and discusses finger jointing of green lumber having an initial moisture content (before kiln drying) of up to about 80%. To provide finger joints in such green lumber Chow teaches kiln drying the pieces for between about 20 and 30 minutes to reduce the initial moisture content from 100–110 percent presumably down to the moisture ranges in the specimens tested. At least the fingers of each joint are then cooled and only after cooling is the adhesive applied, the joints forced together and the adhesive at least partially set to form the finger joints.

It will be apparent that the kiln drying for a period of time of each lumber piece to be joined as taught by Chow dries the green lumber and reduces the moisture content of the whole of each of the wood pieces significantly. The fingers cool faster than the body of each lumber piece and Chow teaches the fingers must first be cooled before the adhesive is applied. The adhesive is then set using in some cases the heat stored in the remainder (bodies) of the wood pieces.

In any of the above techniques the finger jointed wood pieces with the adhesive applied thereto must be crowded together to intermesh the fingers and form the finger joint. The equipment and method for performing this step are well known. (See for example Canadian patent 666,101 or 726,489 issued July 2, 1963 and Jan. 25, 1966 respectively to Glesecke).

The term Green Lumber when used in conjunction with a description of the present invention is intended to mean lumber having a moisture content of at least 28% but the present invention will normally be applied to lumber having average moisture content of over about 50%.

Brief Description of the Present Invention

It is an object of the present invention to provide a method and apparatus for finger jointing green lumber.

Broadly the present invention relates to a method of finger jointing green lumber pieces wherein a first set of fingers are formed at one longitudinal end and a second set of fingers at the other longitudinal end of each said lumber piece, said method comprising applying heat substantially solely to said first set of fingers to dry said first set of fingers and heat said one longitudinal end of each said piece in a first drying station, applying heat substantially solely to said second set of fingers to dry said second set of fingers and heat said other end of each said lumber piece in a second drying station, applying a thermosetting adhesive to one of said first and second sets of fingers, crowding said first set of fingers on one of said lumber pieces into a mating relationship with said second set of fingers on an adjacent lumber piece with said adhesive therebetween to form a joint, said one lumber piece and said adjacent lumber piece having their longitudinal axes substantially in alignment to form said joint, significantly curing said adhesive in said joint by transferring heat energy applied to said one and said adjacent pieces in said first and second drying stations from said fingers to said adhesive, wherein said lumber pieces leave said first drying section and said joint is formed in a time period sufficiently short that said adhesive is significantly cured before significant migration of moisture from said pieces into said joint can interfere significantly with said curing of said adhesive thereby to secure said joint.

Preferably said application of heat to said first set of fingers and to said second set of fingers in said first and second drying stations respectively will be by the application of superheated steam directly to said first and second sets of fingers.

Preferably said application of heat to dry each of said first and said second sets of fingers is less than 10 minutes each and preferably less than 5 minutes and most preferably no longer than 2 minutes each.

Preferably said lumber pieces will be oriented with the longitudinal axis of the fingers of said first and said second set of fingers substantially perpendicular to a direction of movement of said pieces through said first and second drying stations.

Preferably rewetting of said first set of fingers by moisture migration from the body of its respective lumber piece will be impeded at least during the time while said second set of fingers is in said second drying station.

When green lumber pieces having high moisture content (over about 100%) preferably drying conditions will be applied to said first set of fingers at least while said second set of fingers are in said second drying station.

Preferably said adhesive will be applied to said second set of fingers immediately after said second set of fingers leave said second drying station and said first fingers on said one piece will be mated with said second fingers on said adjacent piece immediately following the application of adhesive to said second set of fingers.

Preferably in an apparatus for carrying out the method a first recirculating conveyor means for redirecting lumber pieces to a beginning of the process will be provided after said first drying station and a second recirculating conveyor means for redirecting lumber pieces to the beginning of the process will be provided after said second drying station, more preferably the second recirculating conveyor means will be positioned in the process following said glue applicator.

Preferably method will be continuous and said lumber pieces will be moved through said station and said first set of fingers will be formed in a first finger forming station immediately before said pieces move into said first drying station and said second set of fingers will be formed in a second finger forming station immediately before said second drying station.

It is also preferred when relatively wide pieces are to be joined that said lumber pieces be fed in a first orientation with their major faces substantially parallel to the direction of movement through a first finger forming station to form said first set of fingers with the longitudinal axes of said fingers of said first set substantially parallel to said major surfaces and the direction of movement of said lumber pieces through said finger forming station, orienting each said piece to a second orientation perpendicular to said first orientation and moving said pieces through said first drying station, reorienting said pieces so that their major faces are again parallel to the direction of movement, moving said pieces axially to position said other axial ends, moving said pieces laterally through a second finger forming station to form said second set of fingers, orienting said pieces to an orientation so that their major faces are substantially perpendicular to the direction of movement and moving the pieces through said second drying station to dry said second fingers, reorienting said lumber pieces back to said first orientation for said application of adhesive to said second set of fingers.

Brief Description of the Drawings

Further features, objects and advantages will be evident from the following detailed description of the preferred embodiments of the present invention taken in conjunction with the accompanying drawings in which.

Description of the Preferred Embodiments

Figure 1:
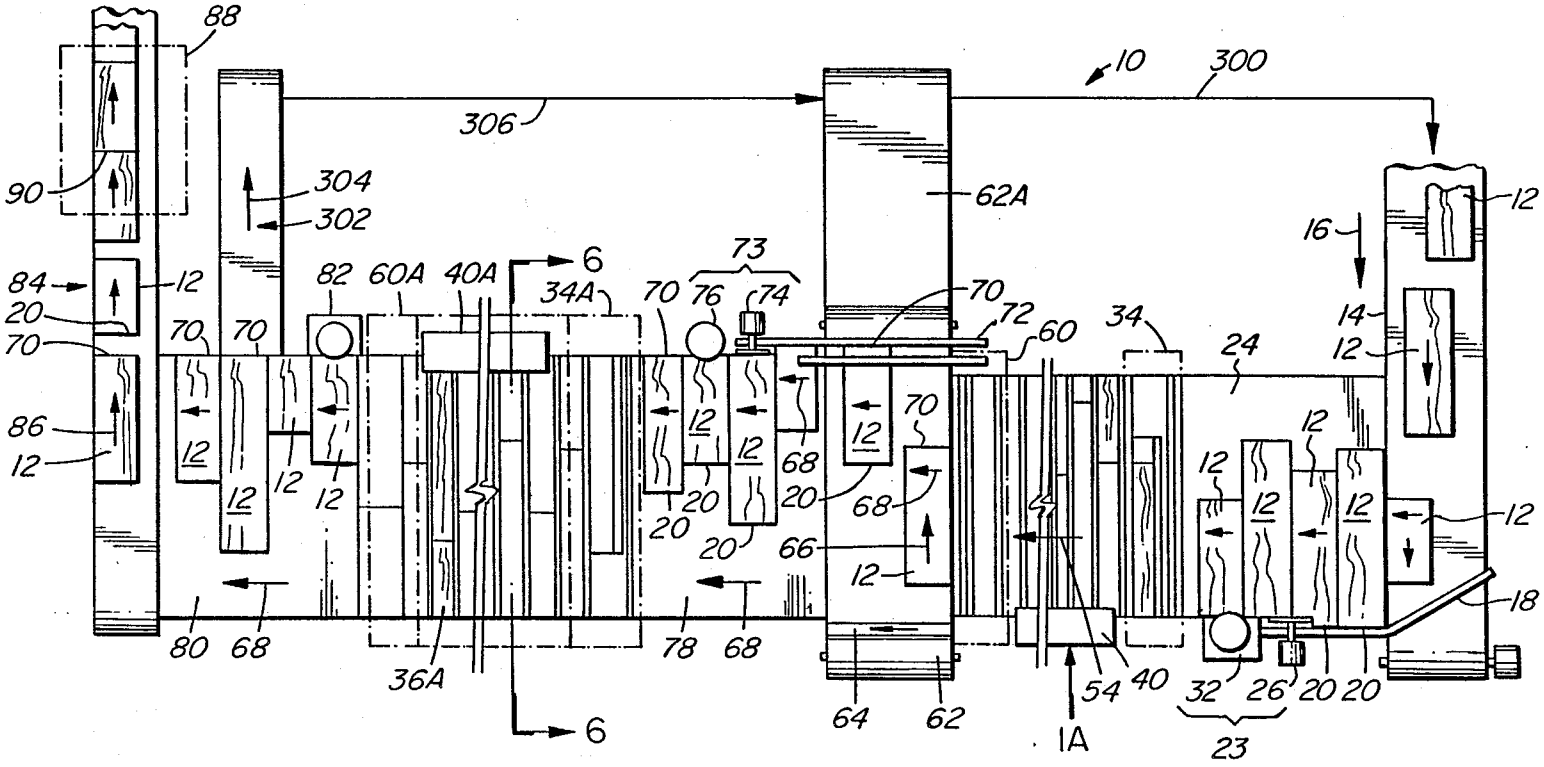
FIG. 1 is a schematic plan view illustrating a preferred arrangement for the present invention.

In the finger jointing system 10 schematically illustrated in FIG. 1 lumber pieces 12 are brought by conveyer 14 moving in the direction arrow 16 into the system.

The leading ends 20 of each of the lumber pieces 12 are moved against a guide plate 18 which tends to align the edges of the ends 20 in a plane as defined by the face of the plate 18 and redirects the lumber piece to move in a direction (arrow 22) substantially perpendicular to the direction of travel 16 and onto a suitable conveyor 24 which continues to move the piece in the direction of arrows 22.

In a finger forming station 23, a trim saw 26 cuts each of the pieces 12 and forms cut free edges 28 aligned in the plane of the blade 30 of the saw 26. The pieces 12, with their edges 28 so aligned, are conveyed by conveyor 24 through the finger profiling station 32 which forms (cuts) the desired profiled fingers 48 (see FIGS. 1B and 3) on one end of each piece 12.

The lumber pieces 12 are all fed along the conveyors 14 and 24 in a first orientation with one of their major surfaces resting against the conveyer surface, i.e. substantially parallel to the direction of movement and in this case substantially horizontal. The longitudinal axes of the fingers so formed is parallel to the direction of movement 22 and thus parallel to the major faces of the pieces 12. In FIG. 1 n spaces between one lumber piece 12 and those adjacent thereto are provided as they are conveyed on conveyor 24 in the direction of the arrows 22 is shown however, in a preferred system suitable dogs or lugs may be provided on the conveyor 24 as indicated at 25 in FIG. 1A on the conveyor 24A to positively position one side edge of each of the lumber pieces 12 and more positively move the pieces 12 in the direction of the arrow 22 through the finger forming station 23.

Figure 1A:
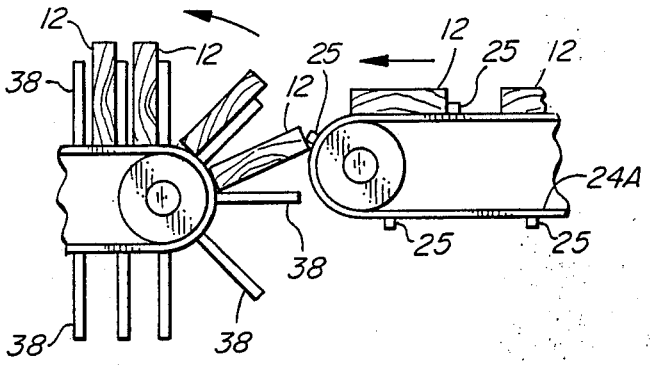
FIG. 1A is a schematic partial side elevation illustrating one form of device for orienting the wood pieces on edge from a first orientation with their major faces parallel to the direction of travel to a second orientation with their major faces perpendicular to the direction of travel.
Figure 1B:
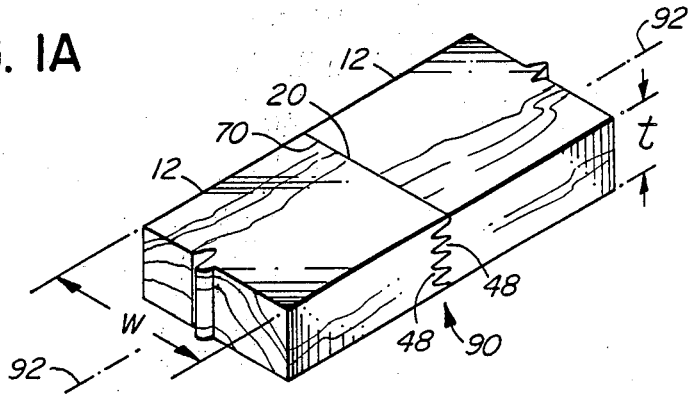
FIG. 1B is an isometric illustration of a typical finger joint made using the present invention.

Attention is directed to FIG. 1B which shows the major surfaces of the pieces 12 are defined by the surfaces having the larger width W and the minor surfaces are smaller and are indicated by the dimension T. W in effect indicates the width of the lumber pieces 12 and T designates the thickness of the lumber pieces 12.

In the arrangement illustrated in FIG. 1 the lumber pieces 12 with a first set of fingers 48 cut at their one end 20 pass into an orienting station 34 which orients the pieces 12 from their first orientation on the conveyor 24 with their major surfaces substantially parallel to the direction of movement (horizontal) into a second orientation (upright) with their major faces substantially (vertical) perpendicular to the direction of movement, i.e. the longitudinal axes of the fingers 48 of the first set of fingers as formed in the finger profiling station 32 are substantially perpendicular to the direction of travel (vertical).

As shown in FIG. 1A orienting the lumber pieces 12 from the first orientation (horizontal) on the conveyor 24 into the second (vertical) orientation in the orienting station 34 may be accomplished by a suitable conveyor 36 having flights 38 extending therefrom and adapted to receive the pieces 12 which are pushed between the flights 38 by the lugs 25. The plates 38 as they travel with the conveyor 36 tilt the pieces 12 from a horizontal into a vertical orientation.

The lumber pieces 12 with their major surfaces vertical are moved through a first drying station 40 where superheated steam preferably is used to dry the fingers 48 and heat the one end 20 of each of the pieces 12.

Figure 2:
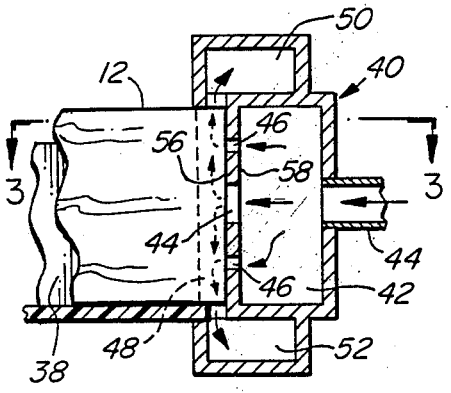
FIG. 2 is a section through the heating stations taken perpendicular to the direction of movement of the lumber pieces through the drying station showing the wood elements with the longitudinal axes of the fingers (major faces) oriented perpendicular to the direction of travel.
Figure 3:
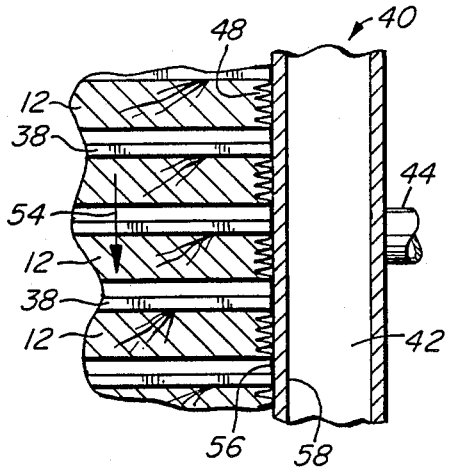
FIG. 3 is a partial section along the line 3—3 of FIG. 2.
Figure 4:
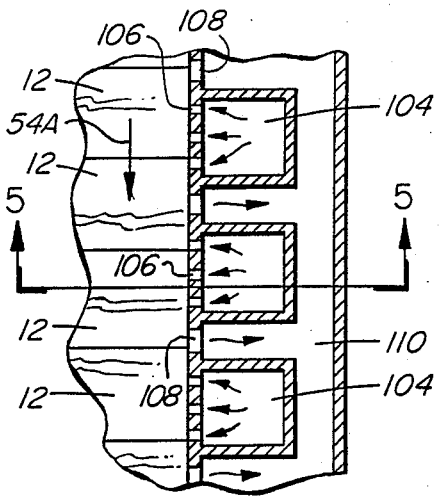
FIG. 4 is a main section of a drying station similar to FIG. 2 but illustrating a modified form of the invention adapted to receive the lumber pieces resting on their major faces and with the longitudinal axis of the fingers (major faces) substantially parallel to the direction of travel.

The heating and drying station 40 shown in section in FIG. 2 and 3 is composed with an inlet steam header 42 having a steam inlet 44 for supply of superheated steam. A wall 58 having a height about equal to the width W of the pieces 12 separates the header 42 from the pieces 12 which are moved by the conveyor 36 as indicated by arrow 54 through the station 40 with the free ends of the fingers 48 wiping along the outside 56 of wall 58. Superheated steam distributed by the inlet header 42 is directed against the fingers 48 through wall 58 through a major outlet 44 located about mid-height of the fingers 48 on the pieces 12 and a pair of smaller outlets 46 one positioned about midway between the outlet 44 and its respective adjacent axial end of the fingers 48. These outlets 44 and 46 may be in the form of rows of perforations or slits extending substantially the full length of the first drying and heating station 40.

The steam travels from the outlets 44 and 46 up and/or down the passages formed by the spaces between the fingers 48 (see FIG. 3) and is received in return headers 50 and 52 one positioned above the lumber pieces 12 and one below. Steam from these headers 50 and preferably is returned (after suitable treatment) to the boiler (not shown) for reheating and reuse.

It will be apparent that each of the board pieces 12 passes through the drying station 40 with its wide faces substantially vertical and its narrow end faces substantially horizontal, i.e. the wide faces (and thus longitudinal axes of the fingers 48) are perpendicular to the direction 54 of movement of the lumber pieces 12 through the first dryer 40.

The superheated steam (preferably at a temperature of 500° -550° C.) applied to the fingers 48 through the outlets 44 and 46 contacts the fingers 48 and passes along (between) the fingers up to the headers 50 and 52. The maximum length of travel of the steam along the fingers is determined by the distance from the centre of the aperture 44 to the header 50 or 52.

The length of the first heating station 40 measured in the direction of travel of the lumber pieces 12, i.e. arrow 54 and the speed of the conveyor 36 determines the time the first ends 20 of the lumber pieces 12 are heated and the steam temperature determines the drying temperature to which the fingers 48 are subjected which must be sufficient to completely dry the fingers 48. It is preferred to minimize the drying time commensurate with maintaining the quality of the wood in the fingers. Drying times will not exceed about 10 minutes, preferably 5 minutes and in a commercial system preferably will not exceed 2 minutes. Surprisingly it has been found that with superheated steam of a temperature in the order of about 500° -550° F. the fingers of even wet cedar having a moisture content of over 150% could be dried in about 2 minutes.

After leaving the drying station 40 the lumber pieces 12 are moved by conveyor 36 into a second orienting station 60 which operates in a manner similar to the first orienting station 34 but in reverse, i.e. station 60 orients the piece 12 so that their major surfaces are substantially horizontal or parallel to the direction of travel from an orientation wherein the pieces 12 were vertical and moved with their major surfaces substantially perpendicular to the direction of travel.

As schematically illustrated by the conveyors 62 and 64 the wood pieces 12 supported on their major faces are moved in the direction of the arrows 66 (conveyor 62) and of the arrow 68 (conveyor 64) to move the other or opposite ends 70 of the lumber pieces 12 against a stop plate 72 and align these ends 70 for feeding into the finger forming station 73 having a second sawing station 74 and second finger profiling station 76 which profiles the opposite ends 70 of each of the pieces 12. The pieces 12 are carried through the stations 74 and 76 travelling in the direction of the arrow 68 on a suitable conveyor 78. The stations 73 is essentially the same as the first finger forming station 23 described above and well known in the industry.

The pieces 12 profiled to have fingers 48 at both ends, i.e. at their one ends 20 and their opposite or other end 70 are delivered into a third orienting station 34A substantially the same as the orienting station 34 which moves the pieces 12 from resting on their major surfaces (major surfaces substantially parallel to the direction of movement) into an orientation where they are standing on their side edges and have their major surfaces substantially vertical (perpendicular to the direction of movement). The lumber pieces 12 so oriented are carried through a second drying station 40A which is essentially the same as the drying station 40 and incorporates a conveyor (not shown) equivalent to conveyor 36. The second drying station applies superheated steam directly to the fingers 48 at the other ends 70 of the pieces 12 to substantially solely apply heat directly to the fingers 48 at the ends 70.

The lumber pieces 12, after drying of the fingers 48 at the end 70, are then reoriented to travel on their major faces (major surfaces parallel to the direction of travel) in the fourth orienting station 60A which is essentially the same as the station 60 and are conveyed via a conveyor 80 through an adhesive applying station 82 and then into the conventional assembling station generally indicated at 84. The wood pieces 12 travel in the direction of the arrow 68 to the assembling section 84 and then in a perpendicular direction as indicated by the arrow 86 and are crowded together in a crowding station 88 to firmly press the fingers 48 at the other end 70 of an adjacent or trailing piece 12 into the finger 48 at one end 20 of a leading piece 12 and form a joint 90 secured together by the adhesive applied in station 82. A typical finger joint 90 as illustrated in FIG. 1B wherein the fingers 48 at the one end 20 intermesh with the fingers 48 at the other ends 70 to form the joint 90 which extends substantially perpendicular to the longitudinal axis 92 of the lumber pieces 12.

In operation the wood elements 12 are carried by the conveyor 14 in the direction (arrow 16) and moved against the stop plate 18 which aligns their leading ends 20 (i.e. one end of each piece 12). The pieces 12 move in the direction of the arrow 22 into the finger forming station 23 wherein the sawing mechanism 26 forms a squared end 28 aligned for movement through the profiler 32 where the fingers 48 are cut into each of the lumber pieces 12. The pieces 12 are then received between the flights 38 on the conveyer 36 and oriented on their side edges for movement in a direction perpendicular to their major faces (or the longitudinal axes of the fingers 48) through the first drying station 40 to apply heat (through the medium of superheated steam) substantially solely through the fingers 48 at one end 20 of each of the pieces 12 thereby to dry these fingers 48 and heat the one end 20 of each of the pieces 12 to provide heat energy in the fingers 48 and adjacent thereto at the end 20.

After drying of the fingers 48 the pieces 12 are each oriented in station 60 to turn them through 90° so that they are supported on their major surfaces and are moved in the direction of the arrows 66 and 68 to bring their opposite or other ends 70 against plate or guide 72 and align the ends 70 in proper orientation to pass through finger forming station 73 (the sawing station 74 and finger profiling station 76) which acts essentially the same way as station 23 described above.

In the illustrated arrangement the pieces 12 are again oriented on their sides, i.e. to rest on the minor faces (having thickness T) and then moved with their major faces substantially perpendicular to the direction of movement 68 through a second dryer station 40A which is substantially the same as the dryer station 40 to dry fingers formed at the opposite end 70 of each of the lumber pieces 12. After drying of the ends 70 has been completed the lumber pieces 12 are again oriented onto their major faces in the fourth orienting station 60A (equivalent to the station 60) and then pass on conveyor 80 through the adhesive applying station 82 that applies adhesive to the fingers 48 of the end 70 of the pieces 12 and into the assembling station 84 where the pieces 12 are moved as indicated by the arrow 86 and crowded together to press the fingers 48 at the opposite or other end 70 of a piece 12 with the adhesive applied thereto into the mating fingers 48 at one end 20 on another piece 12 to form the joint 90 in the crowding station 88.

If it is desired, i.e. if the ratio of width to thickness of the pieces to be joined is not excessive the orienting station 34, 60, 34A and 60A may be eliminated and the pieces 12 passed through the whole process while continually lying on their major faces (in a direction parallel to their major surfaces). This will normally be done when the length of the dryers 40 and 40A cannot be economically reduced by moving the pieces through them with their major surfaces perpendicular to the direction of travel.

Figure 5:
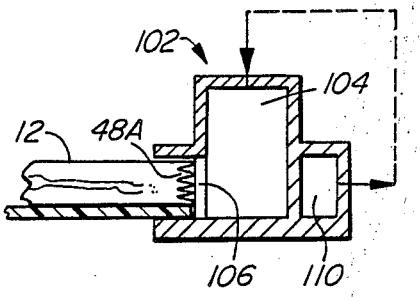
FIG. 5 is a section along the line 5—5 of FIG. 4.

When the pieces 12 are fed through the dryers without reorienting the steam heater must be modified somewhat, preferably to correspond with the system schematically shown in FIG. 5. In this arrangement each of the dryers 100 is provided with a main header 102, that communicates with discrete chambers 104 each of which is provided with a plurality of outlets 106 through a wall 108 and which direct steam from chambers 104 into the passages between the fingers 48A for movement of the steam along the fingers 48A (between the fingers) in a direction parallel to the direction of movement of the elements 12 as indicated by the arrows 54A and into return passages 108. Each return passage 108 leads to a return header 110 which delivers the used steam (after suitable treatment) back to the boiler for reheating and circulation to the chamber 102.

Each of the openings 106 and 108 may be slots extending substantially the full thickness T of the pieces 12.

Regardless of the manner in which the pieces are fed through the dryers the residence time in the dryers is important if a commercially practical system is to be provided. The object is to dry the fingers 48 as quickly as possible without damaging them. It has been found that direct application of superheated steam (temperature of 500+° F.) can dry the fingers of the wet wood e.g. 150+% moisture in less than about 2 minutes.

It is also extremely important that the fingers crowded together in the station 84 be sufficiently dry to permit the adhesive applied in the station 82 to set and that there be sufficient residual heat in the fingers in the immediately adjacent portions of the lumber pieces to cure the adhesive before moisture from the body of the pieces 12 can migrate back to the surfaces of the fingers and interfere with the curing of the adhesive.

In some cases, depending on the moisture content of the pieces 12 entering, it may be practical to operate the system as described and apply sufficient heat to the ends 20 and 70 without damaging the fingers to dry the fingers and store sufficient heat in the ends for curing of the adhesive. The important factor is whether or not the moisture in the remainder of the piece will migrate back to the fingers on the first dried end, i.e. end 20, before the two ends are brought together and the adhesive cured to the required degree. Generally the system described above will be effective if the average moisture content of each of the two pieces 12 being joined is less than about 80% (oven dry).

When the moisture content is higher, it may be necessary, depending on species, to ensure that the ends 20 do not cool sufficiently to permit moisture from the remainder (body) of the pieces to migrate back to the surface of the fingers 48 (before the adhesive sets sufficiently) in the time span between the first drying station 40 and the jointing station 84. If the moisture content of the pieces 12 is not extremely high (above about 120% (bone dry) this may be accomplished by simply preventing the escape of heat from the ends 20, i.e. ends 20 be contained in a warm insulated space 199 surrounding the conveyor(s) moving the pieces 12 from dryer 40 to the assembly station 84 and particularly through the heating or drying station 40A to ensure that the heat escaping from the ends 20 is limited to a degree such that moisture does not migrate to the end 20 in a quantity sufficient to interfere with the curing of the adhesive before the adhesive is cured sufficiently in the station 84. Such an insulated chamber 199 is schematically illustrated by the insulated walls 200, 210, 220 and 230 in FIG. 6. When the heating system 238 to be described below is not used the top wall 230 will be positioned in close proximity to the top of the lumber pieces 12 (see FIG. 6A).

Figure 6:
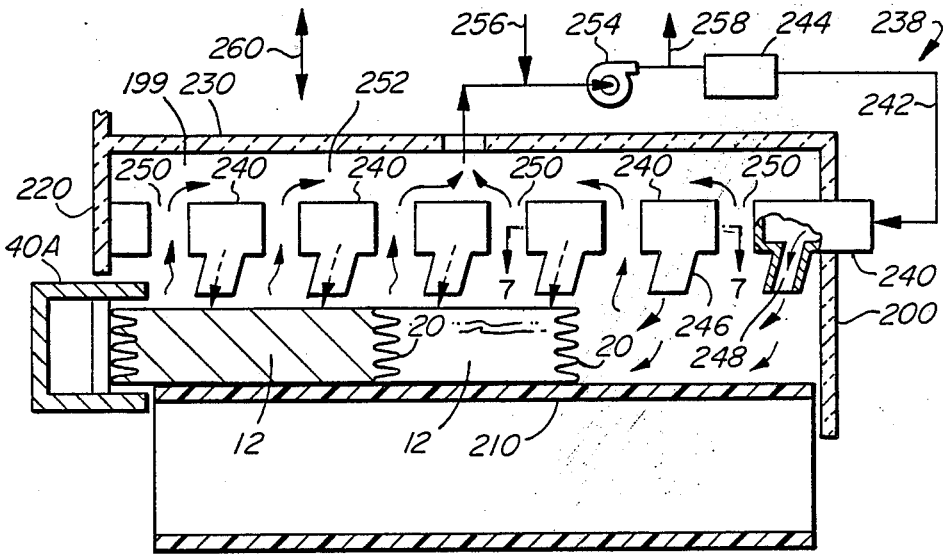
FIG. 6 is a section along the line 6—6 of FIG. 1 schematically illustrating one form of auxiliary dryer for maintaining the first dried end of each wood piece dry.

In the FIG. 6 arrangement, an end heating system 228 is provided surrounding the ends 20 of the pieces 12 as the pieces 12 move through at least the dryer station 40A. In this heating system 238 headers 240 are provided above the pieces 12 and extending in the direction of travel of the pieces 12. Hot air as indicated by the arrow 242 from a suitable source 244 is fed to these headers 240 and is blown from the headers 240 through apertures 248 of nozzles 246 to impinge as which as jets directly on the pieces 12 particularly on the fingers 48 formed at the one end 20 of each of the pieces regardless of the length of the piece (measured parallel to the longitudinal axis of the piece).

It will be noted from FIG. 6 that the apertures 248 of those nozzles 246 immediately overlying the pieces 12 are essentially blocked off by the pieces 12 so that little hot air passes through these orifices to dry the wood. However, where the piece 12 ends as indicated by the end 20 in FIG. 6, the nozzles 248 direct hot air between the adjacent pieces 12 and onto the fingers 48 at the end 20. This hot air after passing over the fingers 48 then returns through the passages 250 between adjacent headers 240 into the return header chamber 252. Return air in chamber 252 is drawn by fan or blower 254, fresh air added as indicated at 256 and some air exhausted as indicated at 258 and recirculated to the heater 244 for return to the headers 240. When the wood pieces are turned on their sides as described with respect to FIG. 1 on the conveyers 36 and 36A with the flights 38 the wood pieces move with their major faces substantially perpendicular to the direction of movement (longitudinal axes of the fingers 48 vertical) the hot air from the nozzles 246 travels along and between the fingers 48 before being redirected back toward the passages 250.

Figure 6A:
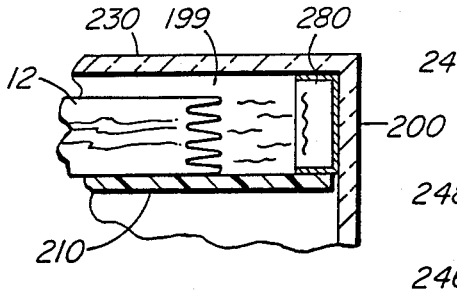
FIG. 6A is a section similar to FIG. 6 but showing a radiant heat at the foot of the auxillary dryer.
Figure 7:
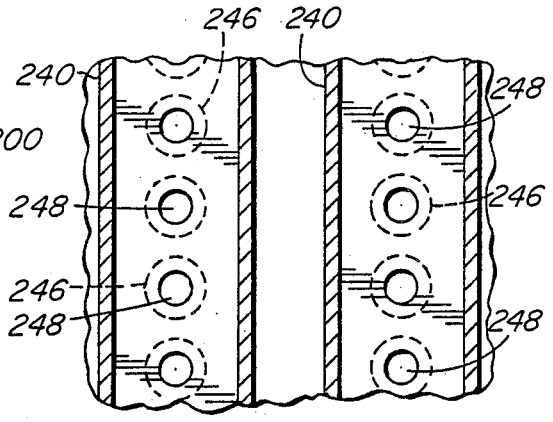
FIG. 7 is a section along the line 7—7 of FIG. 6.

In a simplified version shown in FIG. 6A a radiant heater 280 directing heat into the insulated chamber 199 from the end 200 opposite the dryer 40A is provided. The heating system 238 (heater 280) only tends to dry the first ends or preheated ends 20. If the heating system 238 only extends over dryer section 40A construction is simplified particularly where the pieces are on their sides passing through dryer 40A the height of the chamber 199 need not be changed as indicated by the arrow 260. A heating system 238 extending only the length of dryer station 40A is satisfactory even for very wet wood.

Accommodation must be made for stoppages in the finger jointing system to prevent the wood pieces to be removed therefrom and recirculated to the infeed conveyor 14. In the illustrated arrangement the conveyor 62 is extended as indicated at 62A and provision is made to lift guide 72 so the pieces 12 simply are carried on the conveyor 62A beyond the guide 72 returned to the conveyor 14 as indicated by the arrow 300. Similarly the pieces that are already beyond the conveyor 62 must be returned if there is a shutdown. This may be accomplished by a suitable outfeed conveyor such as that indicated at 302 onto which the pieces are directed to fall by opening a gate (not shown). The pieces 12 are conveyed by the conveyor 302 as indicated by the arrows 304 and 306 back to the conveyor 14 to be reprocessed through the system.

In the above described system the pieces 12 move continuously and the first and second sets of fingers are formed as the pieces 12 move through the system. If desired the fingers may be preformed on the pieces 12 before they enter the system so that the finger forming stations need not be provided in the system.

Examples

Western red cedar lumber of various moisture contents was finger jointed using the above described process wherein the heating time in the dryers 40 and 40A (or their equivalent) was varied and the strength characteristics of the joints so formed (using a phenol resorcinol resin applied to the other end, end 70) was measured both in green and dry condition to determine the characteristics of the joints being formed.

In each of the cases described in Table 1 the superheated steam used in both dryers (i.e. 40 and 40A) was at a temperature of between 500° and 550° F. The first heated end (one end 20) was enclosed in hot air (280° F.) in an insulated chamber while the other end (70) was steam heated. A phenol resorcinol formaldehyde adhesive was applied to the other end after heating and the pieces 12 aligned and mated and a pressure of approximately 350psi applied forcing the ends together. Each test joint assembly was given a post cure time of 7 days. The joined board was ripped into two 2¼ inch wide specimens. One specimen was tested (static bending) in the green state; the other specimen dried under mild oven conditions (120–140° F.) to a moisture content of 12% and then tested in the dry state. The results are given in Table 1.

TABLE 1

| | Western Red Cedar - Finger Jointed Phenol Resorcinol Resin - Applied to the other end (70) | | | | | | | | | |
|---|---|---|---|---|---|---|---|---|---|---|
| Heating Time minutes | Moisture Content of Wood at Manufacture, % | | | MOR, psi Green | | MOR, psi Dry | | Wood Density g/cc | | No. of Samples |
| | Range | x̄ | SD | x̄ | SD | x̄ | SD | x̄ | SD | |
| 0.5 | <20 | 10.9 | 2.27 | 5876 | 1095 | 6278 | 1093 | .332 | .023 | 12 |
| | 40–60 | 88.1 | 12.43 | 2568 | 292 | 4481 | 635 | .305 | .016 | 11 |
| | 70–90 | 92.1 | 14.60 | 2650 | 699 | 4351 | 1219 | .335 | .013 | 10 |
| | >100 | 121.0 | 34.2 | 2474 | 330 | 3815 | 1172 | .361 | .038 | 10 |
| 1.0 | <20 | 11.58 | 2.94 | 5727 | 1468 | 6178 | 1549 | .351 | .046 | 12 |
| | 40–60 | 94.2 | 18.9 | 3306 | 606 | 5486 | 932 | .311 | .020 | 12 |
| | 70–90 | 100.2 | 35.4 | 3522 | 653 | 5936 | 1669 | .325 | .034 | 10 |
| | >100 | 126.8 | 21.2 | 2796 | 497 | 4351 | 1385 | .330 | .030 | 10 |
| 2.0 | <20 | NA | NA | NA | NA | NA | NA | NA | NA | NA |
| | 40–60 | 88.2 | 24.8 | 3310 | 719 | 5163 | 1149 | .295 | .017 | 13 |
| | 70–90 | 102.6 | 24.7 | 2957 | 677 | 5438 | 929 | .317 | .019 | 10 |
| | >100 | 116.4 | 17.9 | 3175 | 310 | 5339 | 955 | .335 | .024 | 10 |

It will be noted with the low drying times, i.e. 0.5 minutes and when the moisture content of the pieces was relatively low the green strength was satisfactory and, the dry strength was quite substantial. With very wet wood and drying for longer times (two minutes) the green strength was also satisfactory and the dry strength was over 5000 psi thereby indicating that even with very wet samples and a drying time of two minutes provided the moisture did not migrate back into the fingers a satisfactory joint could be obtained.

In a test to determine whether any end heating (heating system 238, 280, or the isolated compartment) was necessary during the second drying stage (station 40A), tests were run without the application of forced hot air (or containment in an insulated compartment) and delay times were established between the first drying step (drying one end 20 of each of the pieces) and the second drying step drying the opposite end (70) of the pieces. These times were varied from 1 to 60 minutes and applied to wood pieces of different moisture contents. The bending strength of the resultant joints was measured. Table 2 shows the results of these tests.

TABLE 2

| Delay Time min. | Condition Tested | Bending Strength Test Results: Modulus of Rupture, psi Avg. | Min. | Max. | Std. Dev. | % MC Avg. | Spec. Gr. |
|---|---|---|---|---|---|---|---|
| 0* | green | 2796 | 2088 | 3716 | 497 | 127 | 0.33 |
| | dry | 4351 | 1499 | 6656 | 1385 | | |
| 1 | green | 2320 | 1499 | 3233 | 488 | 96 | 0.31 |
| | dry | 4842 | 2876 | 7803 | 1068 | | |
| 7 | green | 1953 | 1480 | 2439 | 349 | 96 | 0.33 |
| | dry | 4844 | 3620 | 6910 | 1138 | | |
| 11 | green | 2006 | 1377 | 2526 | 377 | 116 | 0.32 |
| | dry | 4458 | 3110 | 7333 | 1319 | | |
| 35 | green | 1675 | 1093 | 2235 | 332 | 129 | 0.31 |
| | dry | 3248 | 2233 | 4308 | 598 | | |
| 60 | green | 1533 | 1112 | 1896 | 261 | 138 | 0.31 |
| | dry | 3627 | 1883 | 5055 | 823 | | |

*denotes normal conditions (control)

It will be apparent that when the dryness of the first dried end (20) was not maintained by the application of hot air or the like average strength of the joint was significantly less than those obtained when the heated air was applied thereby clearly indicating that if no steps are taken to inhibit the wetting of the first dried fingers (end 20) the average moisture content of the pieces must be relatively low to form satisfactory joints. Table 2 implies that as the moisture content or average moisture content of the pieces increases the ability to develop strength is reduced regardless of the time delay when the fingers are not maintained dry, e.g. no end heating is applied.

Having described the invention modifications will be evident to those skilled in the art without departing from the spirit of the invention as defined in the appended claims.

We claim:

1. A method of finger jointing green lumber pieces wherein a first set of fingers is formed at one longitudinal end of each piece and a second set of fingers is formed at the other longitudinal end of said piece, said method comprising applying heat substantially solely to said first set of fingers to dry said first set of fingers and heat said one longitudinal end of each said piece in a first drying station, applying heat substantially solely to said second set of fingers to dry said second set of fingers and heat said opposite end of each said lumber piece in a second drying station, applying a thermosetting adhesive to one of said first and second sets of fingers, crowding said first set of fingers on one of said lumber pieces into a mating relationship with said second set of fingers on an adjacent lumber piece with said adhesive therebetween to form a joint in an assembly station, said one lumber piece and said adjacent lumber piece having their longitudinal axes substantially in alignment to form said joint, curing said adhesive in said joint by transferring heat energy applied to said one and said adjacent pieces in said first and second drying stations from said fingers to said adhesive in a time period so that said lumber pieces leave said first drying station said joint is formed in said assembly station and said adhesive is cured to secure said joint before migration of moisture from said pieces into said joint can interfere with said curing of said adhesive.

2. A method as defined in claim 1 wherein said application of heat to said first set of fingers and to said second set of fingers in said first and second drying station respectively comprises applying superheated steam directly against said first and second sets of fingers respectively.

3. A method as defined in claim 2 wherein said first set of fingers is formed in a first finger forming station immediately before said first drying station and said second set of fingers is formed in a second finger forming station immediately before said second drying station.

4. A method as defined in claim 2 further comprising impeding migration of moisture from the body of a lumber piece into said first set of fingers at least while said second set of fingers on said lumber piece is being dried in said second drying station.

5. A method as defined in claim 3 further comprising impeding migration of moisture from the body of a lumber piece into said first set of fingers at least while said second set of fingers on said lumber piece is being dried in said second drying station.

6. A method as defined in claim 4 wherein said impeding of migration of moisture comprising drying said first set of fingers.

7. A method as defined in claim 5 wherein said impeding of migration of moisture comprising drying said first set of fingers.

8. A method as defined in claim 6 wherein said adhesive is applied to said second set of fingers immediately after said second set of fingers leave said second drying station and said first fingers on said one piece are mated with said second fingers on said adjacent piece immediately following the application of said adhesive to said second set of fingers.

9. A method as defined in claim 7 wherein said adhesive is applied to said second set of fingers immediately after said second set of fingers leave said second drying station and said first fingers on said one piece are mated with said second fingers on said adjacent piece immediately following the application of said adhesive to said second set of fingers.

10. A method as defined in claim 8 further comprising redirecting said lumber pieces to said first finger forming station after said first drying station and redirecting said lumber pieces to said first finger forming station after application of adhesive to said second fingers.

11. A method as defined in claim 9 further comprising redirecting said lumber pieces to said first finger forming station after said first drying station and redirecting said lumber pieces to said first finger forming station after application of adhesive to said second fingers.

12. A method as defined in claim 3 further comprising orienting said lumber pieces in a first orientation with their major faces substantially parallel to the direction of movement through said first finger forming station to form said first set of fingers at said one end, orienting each said piece to a second orientation perpendicular to said first orientation for movement through said first drying station, orienting each said piece so that their major faces are again parallel to the direction of movement, moving said pieces axially to position said opposite axial ends, moving said pieces laterally through said second finger forming station to form said second set of fingers, orienting said pieces to an orientation similar to said second orientation with their major surfaces substantially perpendicular to the direction of movement and passing the wood pieces through said second drying station to heat said second fingers reorienting said lumber pieces to said first orientation for application of said adhesive.

13. A method as defined in claim 4 further comprising orienting said lumber pieces in a first orientation with their major faces substantially parallel to the direction of movement through a first finger forming station to form said first set of fingers at said one end, orienting each said piece to a second orientation perpendicular to said first orientation for movement through said first drying station, orienting each said piece so that their major faces are again parallel to the direction of movement, moving said pieces axially to position said opposite axial ends, moving said pieces laterally through said second finger forming station to form said second set of fingers, orienting said pieces to an orientation similar to said second orientation with their major surfaces substantially perpendicular to the direction of movement and passing the wood pieces through said second drying station to heat said second fingers reorienting said lumber pieces to said first orientation for application of said adhesive.

14. A method as defined in claim 5 further comprising orienting said lumber pieces in a first orientation with their major faces substantially parallel to the direction of movement through a first finger forming station to form said first set of fingers at said one end, orienting each said piece to a second orientation perpendicular to said first orientation for movement through said first drying station, orienting each said piece so that their major faces are again parallel to the direction of movement, moving said pieces axially to position said opposite axial ends, moving said pieces laterally through said second finger forming station to form said second set of fingers, orienting said pieces to an orientation similar to said second orientation with their major surfaces substantially perpendicular to the direction of movement and passing the wood pieces through said second drying station to heat said second fingers reorienting said lumber pieces to said first orientation for application of said adhesive.

15. A method as defined in claim 6 further comprising orienting said lumber pieces in a first orientation with their major faces substantially parallel to the direction of movement through a first finger forming station to form said first set of fingers at said one end, orienting each said piece to a second orientation perpendicular to said first orientation for movement through said first drying station, orienting each said piece so that their major faces are again parallel to the direction of movement, moving said pieces axially to position said opposite axial ends, moving said pieces laterally through said second finger forming station to form said second set of fingers, orienting said pieces to an orientation similar to said second orientation with their major surfaces substantially perpendicular to the direction of movement and passing the wood pieces through said second drying station to heat said second fingers reorienting said lumber pieces to said first orientation for application of said adhesive.

16. A method as defined in claim 6 further comprising orienting said lumber pieces with the longitudinal axis of the fingers of said first and said second set of fingers substantially perpendicular to a direction of movement of said pieces through said first and second drying stations.

17. A method as defined in claim 2 further comprising orienting said lumber pieces with the longitudinal axis of the fingers of said first and said second set of fingers substantially perpendicular to a direction of movement of said pieces through said first and second drying stations.

18. A method as defined in claim 3 further comprising orienting said lumber pieces with the longitudinal axis of the fingers of said first and said second set of fingers substantially perpendicular to a direction of movement of said pieces through said first and second drying stations.

19. A method as defined in claim 4 further comprising orienting said lumber pieces with the longitudinal axis of the fingers of said first and said second set of fingers substantially perpendicular to a direction of movement of said pieces through said first and second drying stations.

20. A method as defined in claim 6 further comprising orienting said lumber pieces with the longitudinal axis of the fingers of said first and said second set of fingers substantially perpendicular to a direction of movement of said pieces through said first and second drying stations.

21. An apparatus for finger jointing green lumber pieces each having a first set of fingers at one longitudinal end and a second set of fingers at the other axial end comprising conveyor means for conveying said pieces through a first drying station having means for applying heat substantially solely to said first set of fingers to dry said first set of fingers and heat said one longitudinal end of each said piece as each said lumber piece is moved therethrough, a second drying station having means for applying heat substantially solely to said second set of fingers to dry said second set of fingers and heat said opposite end of each said lumber piece as each said lumber piece is moved through said second drying station along said conveyor means, means for applying a thermosetting adhesive to one of said first and second sets of fingers, an assembly station said conveyor means moving said lumber pieces past said means for applying adhesive and into said assembly station, said assembly station means for positioning said one lumber piece sand said adjacent lumber piece with their longitudinal axes substantially in alignment and means crowding said first said of fingers on one of said lumber pieces into a mating relationship with said second set of fingers on an adjacent lumber piece with said adhesive therebetween to form a joint, said second finger forming station, said second dryer station, said means for applying adhesive being positioned such that said conveyor means moves said lumber pieces from said first drier station to said assembly station in a time period so that significant curing said adhesive in said joint by transfer of heat energy applied in said first and second drying stations to said adhesive occurs to significantly cure said adhesive before significant migration of moisture from said pieces into said joint can interfere significantly with said curing of said adhesive thereby to secure said joint.

22. An apparatus as defined in claim 21 wherein said first and second drying station include means for directing superheated steam directly against said first and second sets of fingers respectively.

23. An apparatus as defined in claim 22 further comprising a first finger forming station and a second finger forming station to form said first and second sets of fingers respectively, said conveyor means moving said piece through said first finger forming station before said first drying station and through said second finger forming station between said first and said second drying station.

24. An apparatus as defined in claim 22 further comprising means for impeding migration of moisture from the body of a lumber piece into said first set of fingers said means for impeding comprising an insulated compartment in which said first set of fingers on each said piece is contained at least while said second set of fingers is in said second drying station.

25. An apparatus as defined in claim 22 further comprising an end heating system drying said first set of fingers as said lumber pieces are moved through second drying station.

26. An apparatus as defined in claim 25 wherein said end heating system includes means for applying heated dry air directly against said first set of fingers.

27. An apparatus as defined in claim 22 further comprising means for orienting said lumber pieces with the longitudinal axis of the fingers of said first and said second set of fingers substantially perpendicular to a direction of movement of said pieces through said first and second drying stations.

28. An apparatus as defined in claim 22 wherein said conveyor means moves said lumber pieces in a first orientation with their major faces substantially parallel to the direction of movement through said first finger forming station to form said apparatus further comprising means for orienting each said piece to a second orientation perpendicular to said first orientation for movement by said conveyor means through said first drying station, second orienting means for orienting that their major faces are again parallel to the direction of movement after said first drying station, said conveyor means including means for said pieces axially to position said opposite axial ends, and for moving said pieces laterally through said second finger forming station, a third orienting means for orienting said pieces to an orientation similar to said second orientation with their major surfaces substantially perpendicular to the direction of movement, said conveyor means moving the wood pieces through said second drying station while so oriented, a fourth orientating means for reorienting said lumber pieces to said first orientation for movement through said adhesive applying station.

29. An apparatus as defined in claim 22 wherein said conveyor means moves said lumber pieces in a first orientation with their major faces substantially parallel to the direction of movement through said first finger forming station to form said apparatus further comprising means for orienting each said piece to a second orientation perpendicular to said first orientation for movement by said conveyor means through said first drying station, second orienting means for orienting that their major faces are again parallel to the direction of movement after said first drying station, said conveyor means including means for said pieces axially to position said opposite axial ends, and for moving said pieces laterally through said second finger forming station, a third orienting means for orienting said pieces to an orientation similar to said second orientation with their major surfaces substantially perpendicular to the direction of movement, said conveyor means moving the wood pieces through said second drying station while so oriented, a fourth orientating means for reorienting said lumber pieces to said first orientation for movement through said adhesive applying station.

30. An apparatus as defined in claim 24 wherein said conveyor means moves said lumber pieces in a first orientation with their major faces substantially parallel to the direction of movement through said first finger forming station to form said apparatus further comprising means for orienting each said piece to a second orientation perpendicular to said first orientation for movement by said conveyor means through said first drying station, second orienting means for orienting that their major faces are again parallel to the direction of movement after said first drying station, said conveyor means including means for said pieces axially to position said opposite axial ends, and for moving said pieces laterally through said second finger forming station, a third orienting means for orienting said pieces to an orientation similar to said second orientation with their major surfaces substantially perpendicular to the direction of movement, said conveyor means moving the wood pieces through said second drying station while so oriented, a fourth orientating means for reorienting said lumber pieces to said first orientation for movement through said adhesive applying station.

31. An apparatus as defined in claim 25 wherein said conveyor means moves said lumber pieces in a first orientation with their major faces substantially parallel to the direction of movement through said first finger forming station to form said apparatus further comprising means for orienting each said piece to a second orientation perpendicular to said first orientation for movement by said conveyor means through said first drying station, second orienting means for orienting that their major faces are again parallel to the direction of movement after said first drying station, said conveyor means including means for said pieces axially to position said opposite axial ends, and for moving said pieces laterally through said second finger forming station, a third orienting means for orienting said pieces to an orientation similar to said second orientation with their major surfaces substantially perpendicular to the direction of movement, said conveyor means moving the wood pieces through said second drying station while so oriented, a fourth orientating means for reorienting said lumber pieces to said first orientation for movement through said adhesive applying station.

32. A method as defined in claim 2 wherein said superheated steam is applied directly to said second set of fingers for a time period of less than 10 minutes.

33. A method as defined in claim 2 wherein said superheated steam is applied directly to said second set of fingers for a time period less than 5 minutes.

34. A method as defined in claim 2 wherein said superheated steam is applied directly to said second set of fingers for a time period no longer than 2 minutes.

* * * * *